United States Patent [19]

Byers

[11] 4,132,021

[45] Jan. 2, 1979

[54] ANIMATED MOTION DISPLAY MACHINE

[76] Inventor: Thomas L. Byers, 3004 SE. 21, Oklahoma City, Okla. 73115

[21] Appl. No.: 807,716

[22] Filed: Jun. 17, 1977

[51] Int. Cl.[2] ..... G09F 19/00

[52] U.S. Cl. ..... 40/614; 40/429; 46/126

[58] Field of Search ..... 46/126, 138; 40/139, 40/106.3, 53, 614

[56] References Cited

U.S. PATENT DOCUMENTS

| | | | |
|---|---|---|---|
| 1,640,909 | 8/1927 | Schutz | 40/139 |
| 2,646,639 | 7/1953 | Toth | 40/139 |
| 2,932,919 | 4/1960 | Evans | 46/126 X |
| 3,024,551 | 3/1962 | Oppenheim | 40/139 X |

*Primary Examiner*—Russell R. Kinsey
*Assistant Examiner*—Wenceslao J. Contreras
*Attorney, Agent, or Firm*—Robert K. Rhea

[57] ABSTRACT

An upright housing, having a plurality of spaced-apart apertures in its wall arranged in a horizontal plane, supports an electric motor driving a crank member for rotation in the plane of the apertures. An elongated flexible member, connected at one end with the crank member and entrained through a selected one of the apertures, is connected at its other end with an article to be animated by the crank member moving the flexible strand through the selected aperture in a reciprocating action.

4 Claims, 6 Drawing Figures

ANIMATED MOTION DISPLAY MACHINE

BACKGROUND OF THE INVENTION

1. Field of the Invention.

The present invention relates to display advertising and more particularly to an apparatus for imparting animation to articles on display.

In the field of retail advertising displays are often animated to attract the attention of customers and/or demonstrate the use or operation of the product for sale.

2. Description of the Prior Art.

Heretofor animated advertising displays have usually been accomplished by the use of a relatively small electric motor arranged for imparting motion to the article or articles displayed. These little motors usually have a relatively short life span and if battery operated are frequently subject to maintenance problems, such as replacing the batteries. Frequently the motor and its drive components are custom made for the particular type of display to be animated and are seldom reuseable in other displays thus adding to the initial cost of producing an animated display.

This invention provides an apparatus including an electric motor which is adaptable for use in a variety of animated displays and has a relatively long useful life thus permitting the apparatus to be reused over a relatively long period of time.

So far as I know the prior art does not disclose an apparatus of this type.

SUMMARY OF THE INVENTION

An upright housing, having a surrounding vertical wall, is provided intermediate its ends with a horizontal partition. An electric motor is connected to the depending surface of the partition and is supported thereby within the housing. The motor drives a shaft projecting upwardly through the axial center of the partition. A crank member, connected with the shaft, is rotated by the motor in a horizontal plane within the housing. A crank pin is vertically connected with the crank member at a selected location spaced outwardly with respect to the vertical axis of the shaft. for journalling one or more crank pin clips. The housing wall is provided with a plurality of circumferentially spaced apertures arranged in a horizontal plane intersected by the crank pin during rotation of the crank member. One or more elongated flexible strands, each connected at one end with a selected crank pin clip, are each entrained, intermediate their ends, through selected ones of the apertures and connected at their remote ends with an article or articles to be animated after passing through overhead supported pulleys or hooks and are moved in a reciprocating action by rotation of the crank member.

The principal objects of this invention are to provide an advertising display animation apparatus which is simple in construction and operation for imparting motion to one or more objects from a remote location which requires no special tools or skill to install or operate and which has a relatively long useful life.

DESCRIPTION OF THE PREFERRED EMBODIMENT

Figure 1:
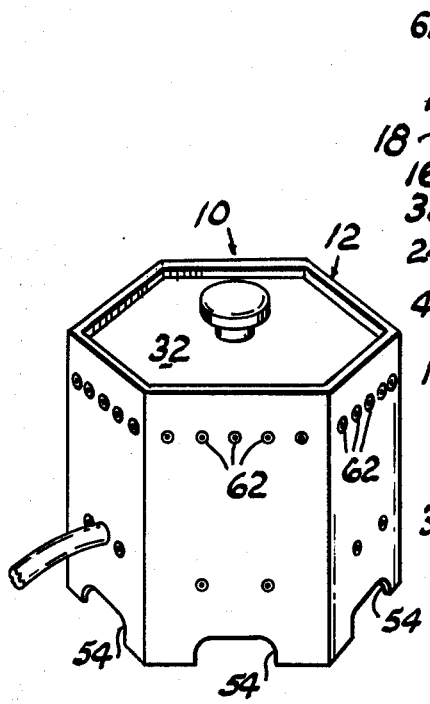
FIG. 1 is a perspective view of the device.
Figure 2:
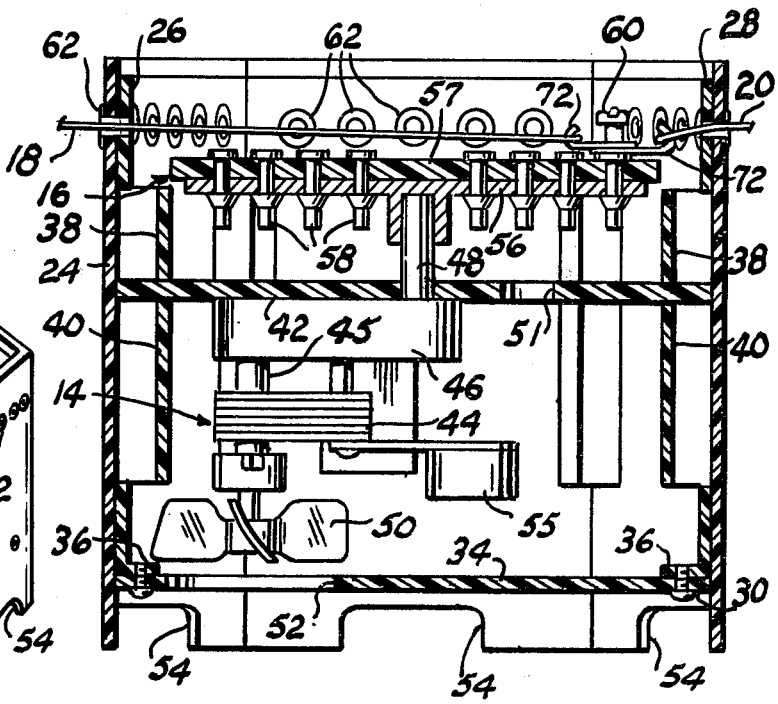
FIG. 2 is a vertical cross sectional view, to an enlarged scale, taken substantially along the line 2—2 of FIG. 3.
Figure 3:
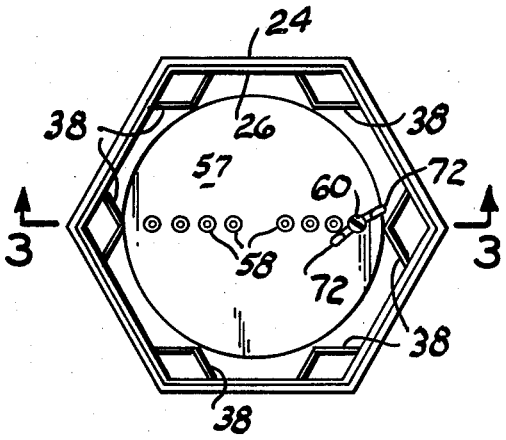
FIG. 3 is a top end view with the lid removed.
Figure 6:
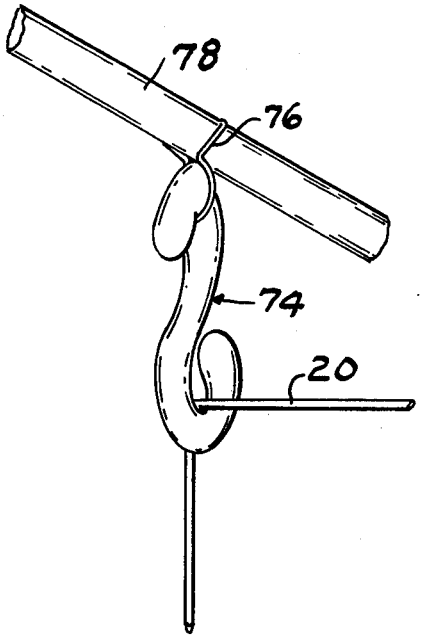
Figure 4:
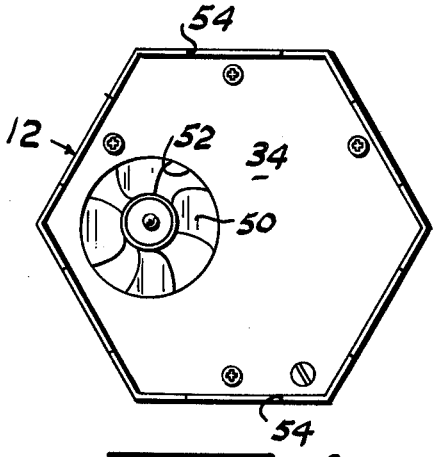
FIG. 4 is a bottom end view.

Like characters of reference designate like parts in those figures of the drawings in which they occur.

Figure 5:
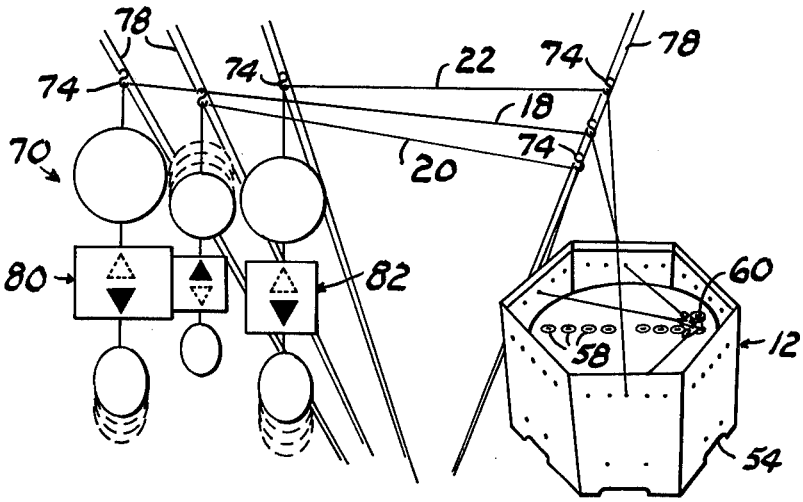
FIG. 5 is a perspective view, with the housing cover removed, illustrating the device operatively connected with articles being animated; and, FIG. 6 is a fragmentary perspective view, to a larger scale, illustrating the manner of supporting one of the flexible strands by an overhead supported hook.

In the drawings:

The reference numeral 10 indicates the device, as a whole, which is cylindrical in general configuration. The device 10 comprises a housing 12 surrounding a motor means 14 driving a crank means 16 for imparting reciprocating motion to a plurality of elongated flexible elements, such as monofilament strands, three in the example shown, 18, 20 and 22 (FIG. 5). The housing 12 is formed by a relatively thin outer wall 24, hexagonal in configuration, to provide a plurality of side wall surfaces from which the flexible strands extend to impart animation to objects and to provide a means of supporting components contained by the housing, as presently explained.

Obviously, the outer wall may be formed of other configurations, such as circular or square, if desired.

An inner wall 26 is secured to the inner surface of the outer wall 24 and terminates in spaced relation with respect to the upper and lower ends of the outer wall to form annular upper and lower shoulders 28 and 30 for respectively supporting a top or cover 32 and a bottom wall 34, the bottom wall 34 being connected with tabs 36 projecting horizontally inward from the depending end of the inner wall 26. Intermediate its ends, the inner wall 26 is provided with upper and lower circumferentially spaced-apart struck-out portions 38 and 40 projecting inwardly of the housing above and below marginal edge portions of a horizontal motor support partition 42 transversely dividing the housing.

The motor means 14 comprises an electric motor 44, having its drive shaft 45 connected with a gear train 46 secured to the depending surface of the partition 42 and having a driven shaft 48 extending vertically through the partition. The motor 44 is provided with a cooling fan 50 for moving air through partition apertures 51, a bottom wall aperture 52 and recesses 54 formed in the depending edge portion of the outer wall 24.

The motor 44 is preferably provided with a thermostat type switch 55 for interrupting motor energizing current in the event the motor should become overheated as a result of being overloaded or malfunction of components being animated.

The crank means 16 comprises a disk 56, in the example shown, coaxially secured in a conventional manner to the driven shaft 48 and rotating in a horizontal plane spaced downwardly with respect to the upper limit of the housing. A plate 57 flatly overlies the disk 56. The disk 56 and plate 57 are provided with a diametric row of vertical apertures arranged in selected spaced relation outwardly of the vertical axis of the shaft 48 for receiving a like plurality of anchor-type screws 58. An upstanding crank pin 60 is removably engaged with a selected one of the screws 58. Obviously, the crank means may comprise a single arm, not shown, connected at one end with the shaft 48 and extending at its other end toward the inner periphery of the housing.

The housing walls 24 and 26 are provided with a row of circumferentially spaced horizontal apertures arranged in a horizontal plane spaced slightly above the plane of the plate 57 which respectively receive a like plurality of eyelets 62.

Operation

In operation the device 10 is preferably disposed in a normally out of sight or hidden position with respect to articles 70 to be animated. In the example shown by FIG. 5, one end of the strands 18 and 20 are each connected with a pair of J-shaped hooks or clips 72 surrounding and journalled by the crank pin 60 for rotation of the crank pin with respect to the crank pin clips 72. The strands 18 and 20 are entrained through a pair of diametrically opposed wall eyelets 62 with the strands further entrained intermediate their ends through S-shaped hooks 74, preferably formed from low friction material, in turn supported by clips or clamps 76 attached to overhead ceiling support members 78. The other ends of the strands 18 and 20 are then connected with opposing end portions of an article 80 to be moved in a tilting or rocking action in response to rotation of the disk 56 and plate 57 moving crank pin 60 in a circular motion and moving the strands 18 and 20 in a reciprocating action through the eyelets 62 and S-hooks 74, the rocking action being indicated by dotted lines (FIG. 5). The strand 22 is similarly connected with the crank pin 60 by another identical clip 72 and entrained through a different one of the eyelets 62 circumferentially spaced from the position of the strands 18 and 20 and similarly entrained over other S-hooks 74 and connected with a different article 82 to be animated in a vertical reciprocating action by the crank pin reciprocating the strand 22, such action being in opposition to the movement of the article 80. Obviously pulleys, not shown, may be used in place of the S-shaped hooks 74, if desired.

Obviously the invention is susceptible to changes or alterations without defeating its practicability. Therefore, I do not wish to be confined to the preferred embodiment shown in the drawings and described herein.

I claim:

1. An animated display drive, comprising:
an electric motor having a drive shaft;
a housing having an upright wall surrounding said motor in supporting relation,
said wall having a plurality of spaced-apart apertures arranged in a horizontal plane;
crank means within said housing,
said crank means including horizontal disk means having at least one vertical aperture spaced outwardly with respect to the axis of the disk means,
an anchor screw contained by the disk means aperture, and,
a crank pin secured to said anchor screw;
means connecting said drive shaft with said crank means for rotating the latter in the horizontal plane of the wall apertures; and,
at least one flexible element extending, intermediate its ends, through one of the apertures and connected at one end with said crank means and being connected at its other end with a display element to be animated.

2. The animated display device according to claim 1 in which said connecting means comprises:
a partition transversely dividing said housing; and,
a gear train secured to said partition and drivably connected with said motor drive shaft,
said gear train having a driven shaft projecting through said partition and secured to said disk means.

3. The animated display device according to claim 2 and further including:
at least one crank pin clip journalled by said crank pin; and,
an elongated flexible member connected at one end with said clip and entrained through one of the wall apertures for connection at its other end portion with an article to be animated.

4. The animated display device according to claim 3 and further including:
at least one S-shaped hook having a low coefficient of friction for slidably supporting said flexible element intermediate its ends.

* * * * *